US007911302B2

(12) United States Patent
Sudhakar et al.

(10) Patent No.: US 7,911,302 B2
(45) Date of Patent: Mar. 22, 2011

(54) SECONDARY TRIP SYSTEM FOR CIRCUIT BREAKER

(75) Inventors: Sapuram Sudhakar, Begumpet Hyderabad (IN); Deepak Raorane, Secunderabad (IN); Arvind Pai, Karnataka (IN); Kapil Bavikar, Hyderabad Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 221 days.

(21) Appl. No.: 11/940,601

(22) Filed: Nov. 15, 2007

(65) Prior Publication Data

US 2009/0128265 A1 May 21, 2009

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 53/00*** | (2006.01) |
| ***H01H 9/00*** | (2006.01) |

(52) U.S. Cl. ..... 335/172; 335/8; 335/16; 335/147

(58) Field of Classification Search ..... 335/6, 8–10, 335/172, 16, 147, 195

See application file for complete search history.

(56) References Cited

U.S. PATENT DOCUMENTS

| | | | | | |
|---|---|---|---|---|---|
| 2,695,345 | A * | 11/1954 | Scott, Jr. | 335/10 |
| 3,098,910 | A * | 7/1963 | Schwartz | 335/9 |
| 3,562,469 | A * | 2/1971 | Peck | 200/5 R |
| 3,786,380 | A * | 1/1974 | Harper | 335/9 |
| 4,079,345 | A * | 3/1978 | Pietsch | 335/10 |
| 4,275,370 | A * | 6/1981 | Sims | 335/37 |
| 4,346,356 | A * | 8/1982 | Fujiwara et al. | 335/6 |
| 4,687,891 | A * | 8/1987 | Bartolo et al. | 200/560 |
| 4,725,799 | A * | 2/1988 | Bratkowski et al. | 335/14 |
| 4,740,770 | A * | 4/1988 | Lazareth et al. | 335/171 |
| 4,748,428 | A * | 5/1988 | Toda et al. | 335/10 |
| 4,754,245 | A * | 6/1988 | Toda et al. | 335/17 |
| 4,754,246 | A * | 6/1988 | Toda et al. | 335/21 |
| 4,916,420 | A * | 4/1990 | Bartolo et al. | 335/172 |
| 4,916,421 | A * | 4/1990 | Pardini et al. | 335/185 |
| 5,023,583 | A * | 6/1991 | Bratkowski et al. | 335/195 |
| 5,579,901 | A * | 12/1996 | Faber et al. | 200/401 |
| 5,990,434 | A * | 11/1999 | Fujihira et al. | 200/401 |
| 6,018,284 | A | 1/2000 | Rival et al. | |
| 6,259,342 | B1 * | 7/2001 | Malingowski et al. | 335/202 |
| 6,317,019 | B1 * | 11/2001 | Herpin et al. | 335/8 |
| 6,376,788 | B1 | 4/2002 | Jones et al. | |
| 6,404,314 | B1 * | 6/2002 | Arnold et al. | 335/258 |
| 6,437,670 | B1 | 8/2002 | Castonguay et al. | |
| 6,507,256 | B1 * | 1/2003 | Castonguay et al. | 335/172 |
| 6,657,524 | B2 * | 12/2003 | Bach et al. | 335/6 |
| 6,667,680 | B1 * | 12/2003 | Gibson et al. | 336/172 |
| 6,724,286 | B2 * | 4/2004 | Arnold et al. | 335/273 |
| 6,819,205 | B2 | 11/2004 | Bach et al. | |
| 6,924,720 | B2 * | 8/2005 | Miura et al. | 335/165 |
| 6,977,568 | B1 | 12/2005 | Rakus et al. | |
| 7,009,129 | B2 * | 3/2006 | Vierling | 200/400 |
| 7,105,764 | B2 | 9/2006 | Rakus et al. | |
| 7,115,829 | B2 * | 10/2006 | Schmid | 200/400 |
| 2004/0061580 | A1 * | 4/2004 | Miura et al. | 335/172 |
| 2004/0227601 | A1 * | 11/2004 | Brignoni et al. | 335/172 |

* cited by examiner

*Primary Examiner* — Lincoln Donovan
*Assistant Examiner* — Alexander Talpalatskiy
(74) *Attorney, Agent, or Firm* — Cantor Colburn LLP

(57) ABSTRACT

A mechanism for a circuit breaker contact arm that allows current limiting by reducing the opening time is disclosed. A secondary trip assembly is arranged to actuate due to magnetic forces generated during an undesirable electrical condition such as a short circuit. The secondary trip system releases a contact arm assembly allowing the contact arm to rotate to an open position that interrupts the flow of electrical power.

19 Claims, 10 Drawing Sheets

SECONDARY TRIP SYSTEM FOR CIRCUIT BREAKER

BACKGROUND OF THE INVENTION

The subject matter disclosed herein relates to a mechanism for a circuit breaker. In particular, the subject matter disclosed herein relates to a mechanism coupled to a contact arm to provide current limiting functionality by reducing the opening time.

Air circuit breakers are commonly used in electrical distribution systems. A typical air circuit breaker comprises an assembly of components for connecting an electrical power source to a consumer of electrical power called a load. The components are referred to as a main contact assembly. In this assembly, a main contact is typically either opened, interrupting a path for power to travel from the source to the load, or closed, providing a path for power to travel from the source to the load. In a particular type of circuit breaker, referred to as an air circuit breaker, the force necessary to open or close the main contact assembly is provided by an arrangement of compression springs. When the compression springs discharge, they exert a force that provides the energy needed to open or close the main contacts. Compression springs that provide a force to close the main contacts are often called closing springs. Compression springs that provide a force to open the main contacts are often referred to as contact springs.

The mechanism for controlling the compression springs comprises a configuration of mechanical linkages between a latching shaft and an actuation device. The actuation device may be manually or electrically operated. An electrically operated actuation device generally operates when a particular electrical condition is sensed, for example, over-current or short-circuit conditions. The actuation device within the circuit breaker typically imparts a force onto a linkage assembly. The linkage assembly then translates the force from the actuation device into a rotational force exerted on the latching shaft. The latching shaft then rotates. This rotation is translated through the mechanical linkages to unlatch or activate either the closing springs or the contact springs. There is typically a first latching shaft mechanically linked to the closing springs called the closing shaft. A second latching shaft is mechanically linked to the contact springs called the tripping shaft.

As each actuation device acts upon the latching shaft via a corresponding linkage assembly, the linkage assembly acts as a lever converting a linear force from the actuation device to a rotational force on the latching shaft. The time required for the actuation device to be electrically activated and initiate movement of the mechanism and the contact assembly can be lengthy. Where an undesirable electrical condition exists, this time period required to open the contact assembly may be longer than desired.

While existing circuit breakers are suitable for their intended purposes, there still remains a need for improvements particularly regarding the operation of the circuit breaker and the time required to open the contacts under high current and short circuit conditions.

SUMMARY OF THE INVENTION

A circuit breaker is provided having a contact structure movable between a closed and an open position. A contact carrier is coupled to the contact structure wherein the contract carrier has a slot. A first mechanism is coupled to the contact carrier by a shaft disposed in the slot. The shaft is rotatable and movable between a first position and a second position in the slot. A second mechanism is operably coupled to the shaft where the second mechanism includes a first linkage coupled to the shaft and an armature operably coupled to the first linkage.

A magnetic trip device for a circuit breaker is also provided including an armature movable between an open position and a closed position. A first link is movable between a first position and a second position and is operably coupled to said armature. A shaft is coupled to rotate with the first link where the shaft has a cylindrical portion and a planar portion thereon. A contact arm carrier having a slot with a first end and a second end is positioned such that the shaft is arranged in the slot.

A multi-pole circuit breaker is also provided having a mechanism movable between a first and second position. A first contact arm assembly including at least one contact arm and a contact arm carrier having a slot has a circular portion and an elongated portion. A first link is coupled between the mechanism and the contact arm carrier by a shaft positioned in the slot. Wherein said shaft is arranged to rotate between a first position and a second position in the slot circular portion. An armature is operably coupled to rotate the shaft from the first position to the second position.

BRIEF DESCRIPTION OF THE DRAWINGS

Referring now to the drawings, which are meant to be exemplary and not limiting, and wherein like elements are numbered alike.

DETAILED DESCRIPTION

Figure 1:
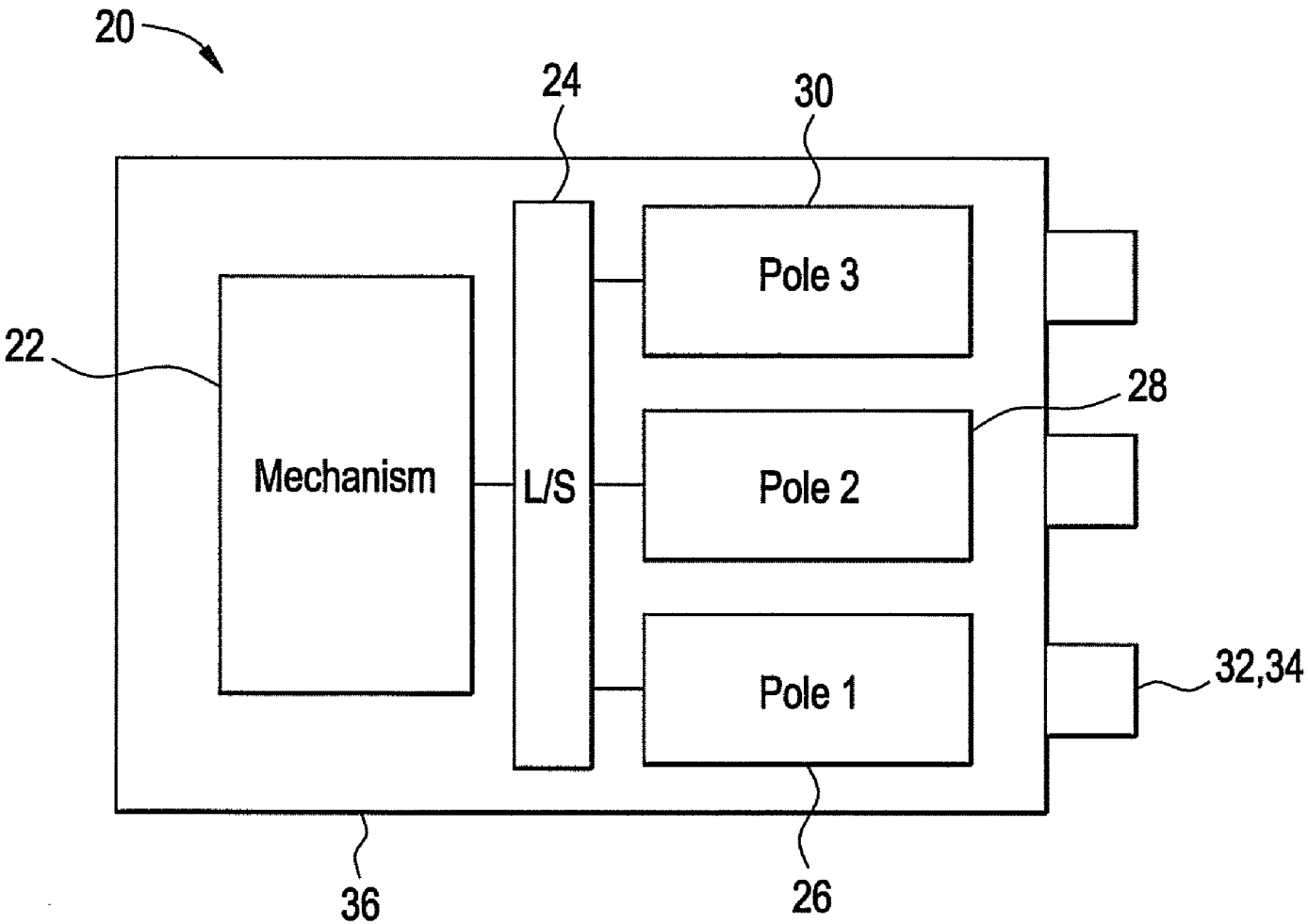
FIG. 1 is a top schematic illustration of a multi-pole circuit breaker of the exemplary embodiment.

FIG. 1 illustrates a multi-pole circuit breaker 20 having a main mechanism 22. The mechanism 22 includes a lay shaft ("L/S") assembly 24 that couples the mechanism 22 to the pole assemblies 26, 28, 30. The mechanism provides a means for an operator to open, close and reset the pole assemblies 26, 28, 30 and will typically include an operator interface. The mechanism will further include a trip unit (not shown) that detects undesired electrical conditions and upon sensing of such a condition activates the mechanism 22. As will be described in more detail herein, the pole assemblies 26, 28, 30 conduct electrical current through the circuit breaker 20 and provide the means for connecting and disconnecting the protected circuit from the electrical power source.

In the exemplary embodiment, each pole of the multi-pole circuit breaker 20 carries a different electrical phase. Each of the pole assemblies 26, 28, 30 is coupled to a pair of conductors 32, 34 that connects the circuit breaker 20 to the protected load and the electrical power source. Typically, a housing 36 surrounds the mechanism 22 and the pole assemblies 26, 28, 30 to protect the components and prevent inadvertent contact by the operator with electrical current.

Figure 2:
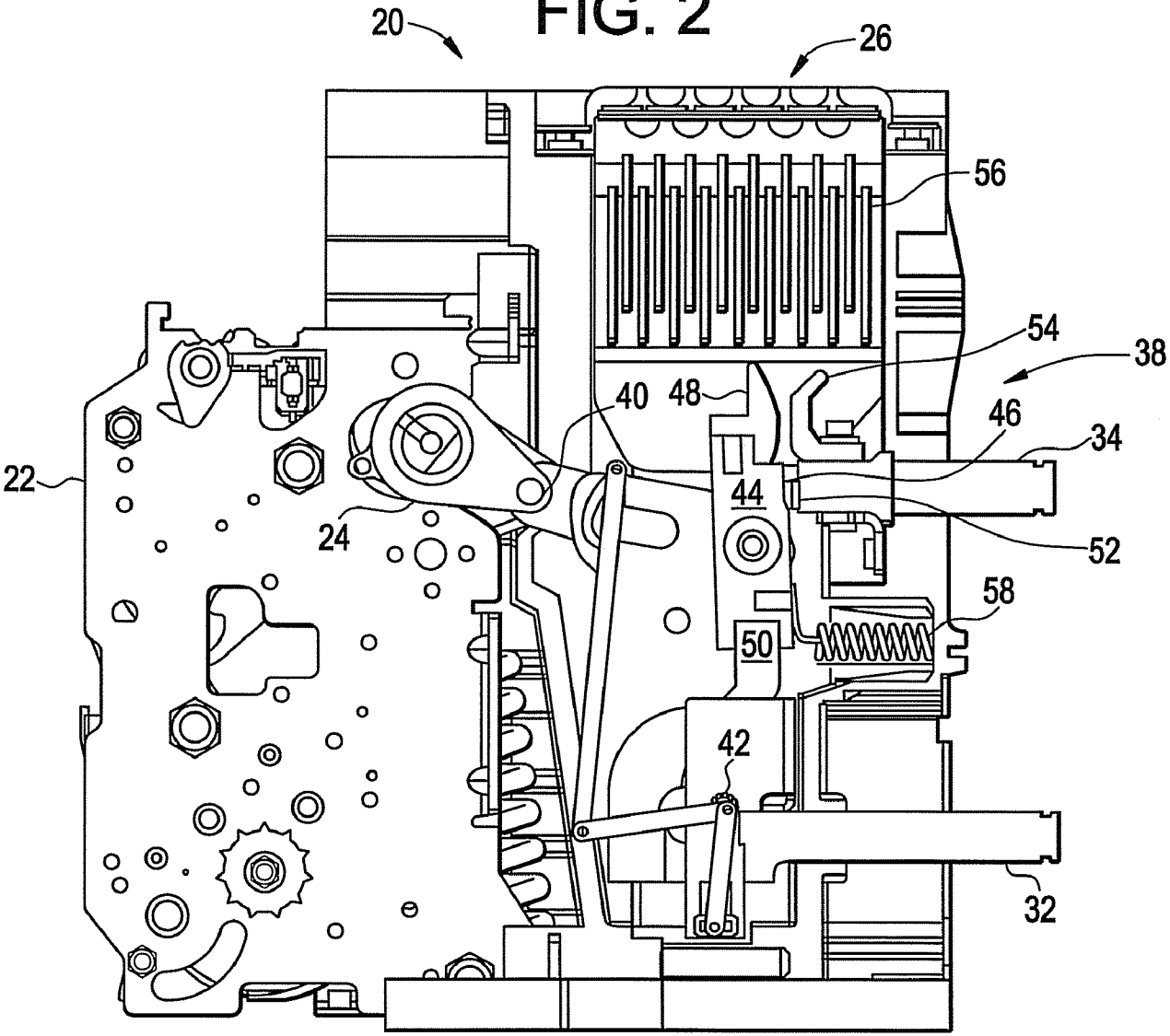
FIG. 2 is a side plan view illustration of a circuit breaker of FIG. 1 in the closed position in accordance with the exemplary embodiment.

The circuit breaker 20 is illustrated with the pole 26 in the closed position in FIG. 2. The lay shaft assembly 24 is coupled to a contact arm assembly 38 through a pin 40. As will be described in more detail herein, the contact arm assembly 38 as illustrated in FIG. 2 is in a locked position and transfers the energy from the mechanism 22 that is necessary to open and close a contact arm 44. The contact arm assembly 38 is mounted in the circuit breaker 20 to pivot about a pin 42 to move between a closed, an open and a tripped position. Each of the other pole assemblies 28, 30 also includes a contact arm assembly 38 with each respective contact arm assembly coupled to the mechanism through the lay shaft assembly 24.

Figure 6:
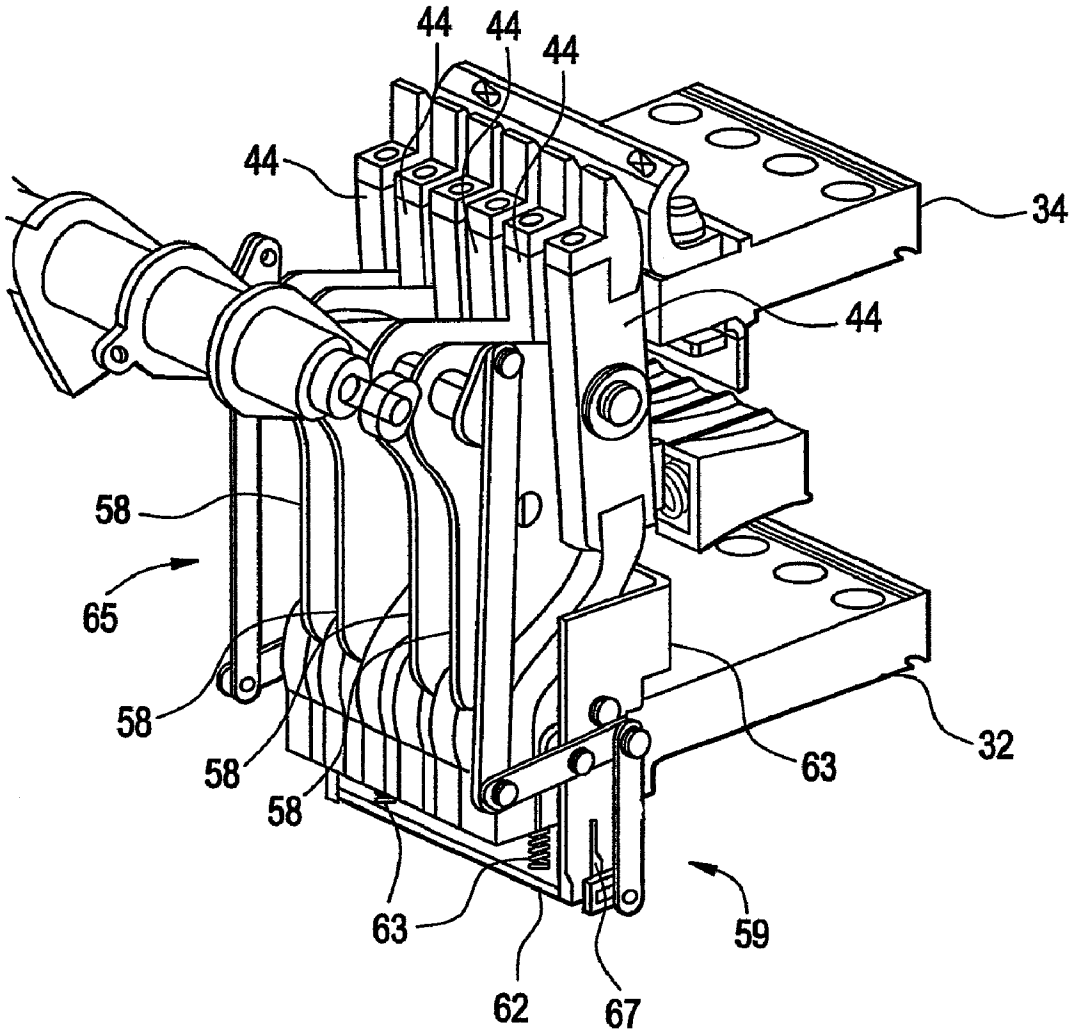
FIG. 6 is a perspective view illustration of the contact arm mechanism of FIG. 5.

The contact arm assembly 38 includes the contact arm 44 having a movable contact 46 and an arcing contact 48 mounted to one end. A flexible, electrically conductive strap 50, made from braided copper cable for example, is attached to the opposite end of the movable contact 46. The flexible strap 50 electrically couples the contact arm 44 to the conductor 32 that allows electrical current to flow through the circuit breaker 20. The electrical current flows through the contact arm assembly 38 and exits via movable contact 46. The current then passes through stationary contact 52 and into conductor 34 where it is transmitted to the load. It should be appreciated that the terms "load" and "line" are for convenience, and the connections to the load and electrical supply may be reversed for certain circuit breaker applications. The contacts 46, 52 are typically made from Silver Tungsten and Silver Graphite composite to minimize resistance. Another arcing contact 54 is mounted to the conductor 34. The arcing contacts 48, 54 assist the circuit breaker 20 in moving any electrical arc formed when the contact arm 44 is opened into an arc chute 56. A compression spring 90 is mounted to the circuit breaker 20 to exert a force on the bottom side of the contact arm 44 and assist with the opening of the contact arm assembly 38. It should be appreciated that the contact arm 44 may be a single component or may be composed of several parallel contact arms as illustrated in FIG. 6. In this embodiment, the contact arm assembly 38 will also include several contact arm carriers 58 that support and separate the individual contact arms 44.

The circuit breaker 20 also includes a secondary trip assembly 59. The secondary trip assembly 59 includes a magnetic device that includes a fixed core 60 and a movable armature 62. The fixed core 60 is electrically coupled to the conductor 32 and arranged to generate a magnetic field in proportion to the electrical current flowing through the conductor 32. In the exemplary embodiment, the fixed core and movable armature are made from magnetic material, steel for example. As shown in FIG. 6, a pair of springs 63 separates and bias' the armature 62 from the fixed core 60. Alternatively, more than two springs may be utilized to bias the armature from the fixed core. In the exemplary embodiment, the armature 62 is coupled to a frame 57 that has one or more slots 67. The slots 67 guide the motion of the armature during movement of the armature 62 caused by the magnetic field generated by fixed core 60.

The linkage assemblies 64, 65 are coupled to the armature 62. Each linkage assembly includes a first link 78 that is coupled at one end to the armature 62 by a pin that allows rotation of the link 78 relative to the armature 62. A second link 74 has a pivot 76 that is attached to the frame 57. The second link 74 is coupled at one end to first link 78 and at the opposite end to a third link 72. The third link in turn couples the second link 74 with a fourth link 70. Fourth link 70 is attached to a shaft 66. As will be described in more detail below, the linkage assembly 64 translates the linear motion of the armature 62 into a rotational movement of the shaft 66.

Figure 3:
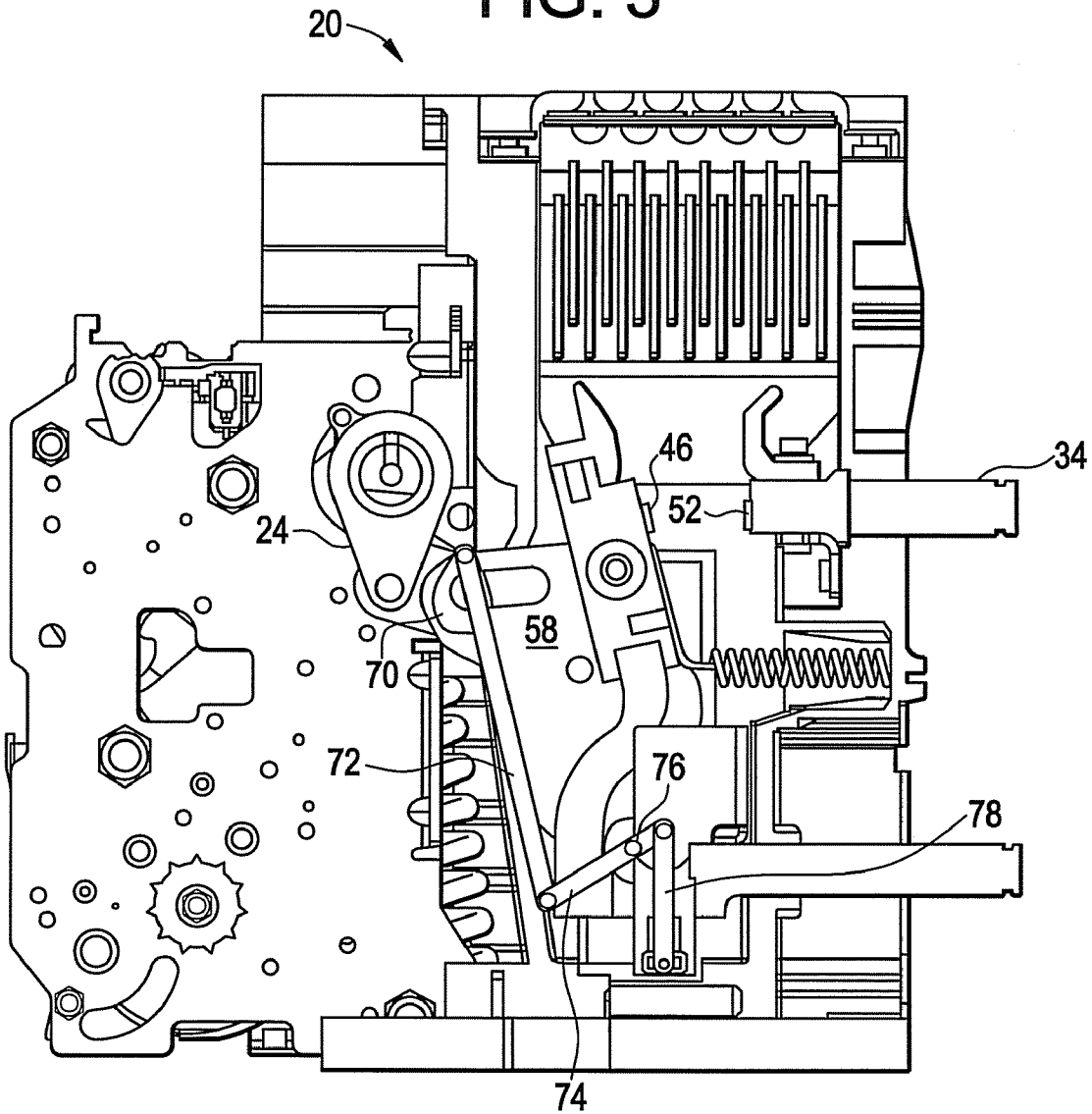
FIG. 3 is a side plan view illustration of the circuit breaker of FIG. 1 in the open position.
Figure 7:
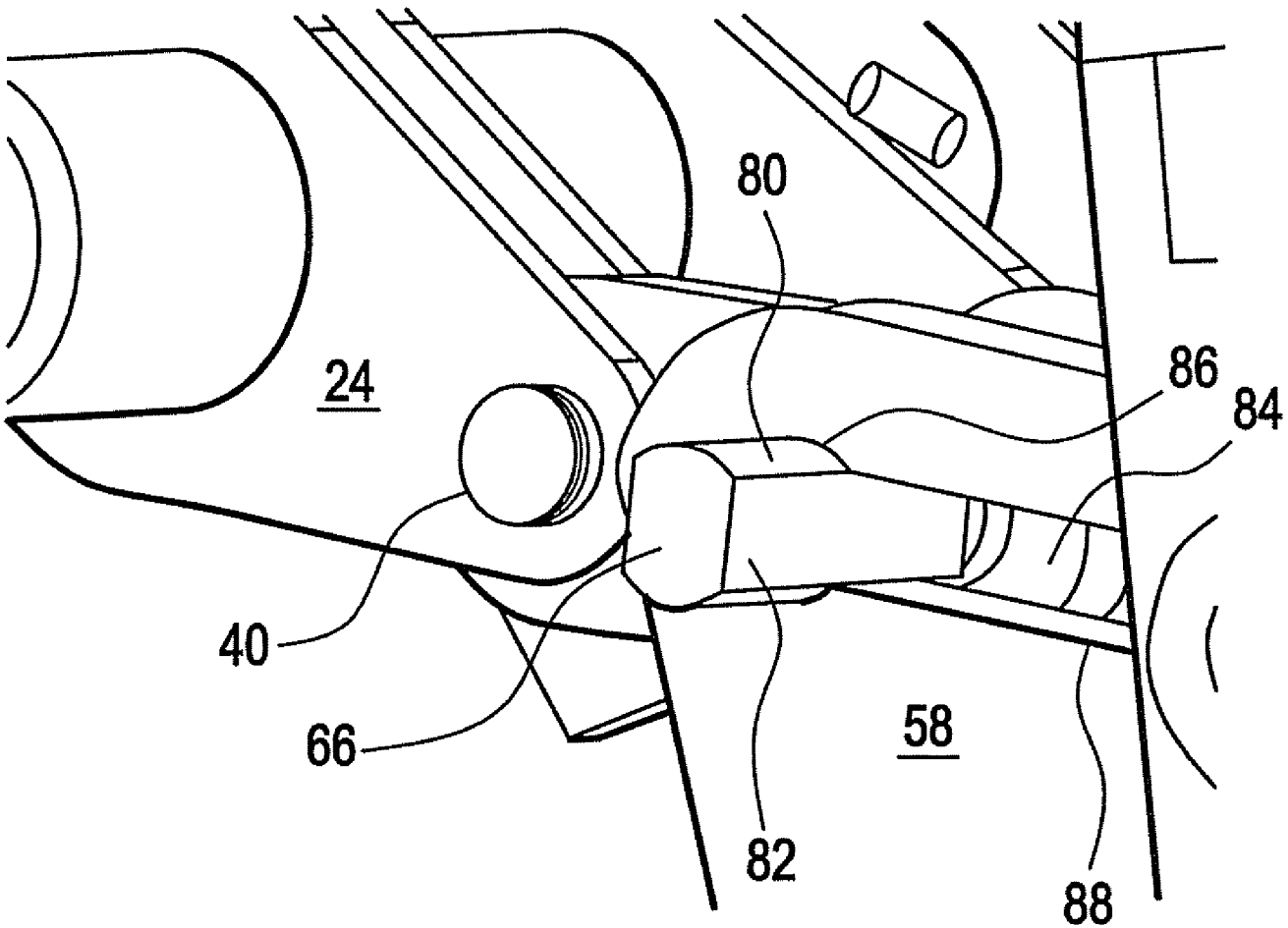
FIG. 7 is a partial perspective view illustration of the contact arm carrier assembly of FIG. 4.
Figure 8:
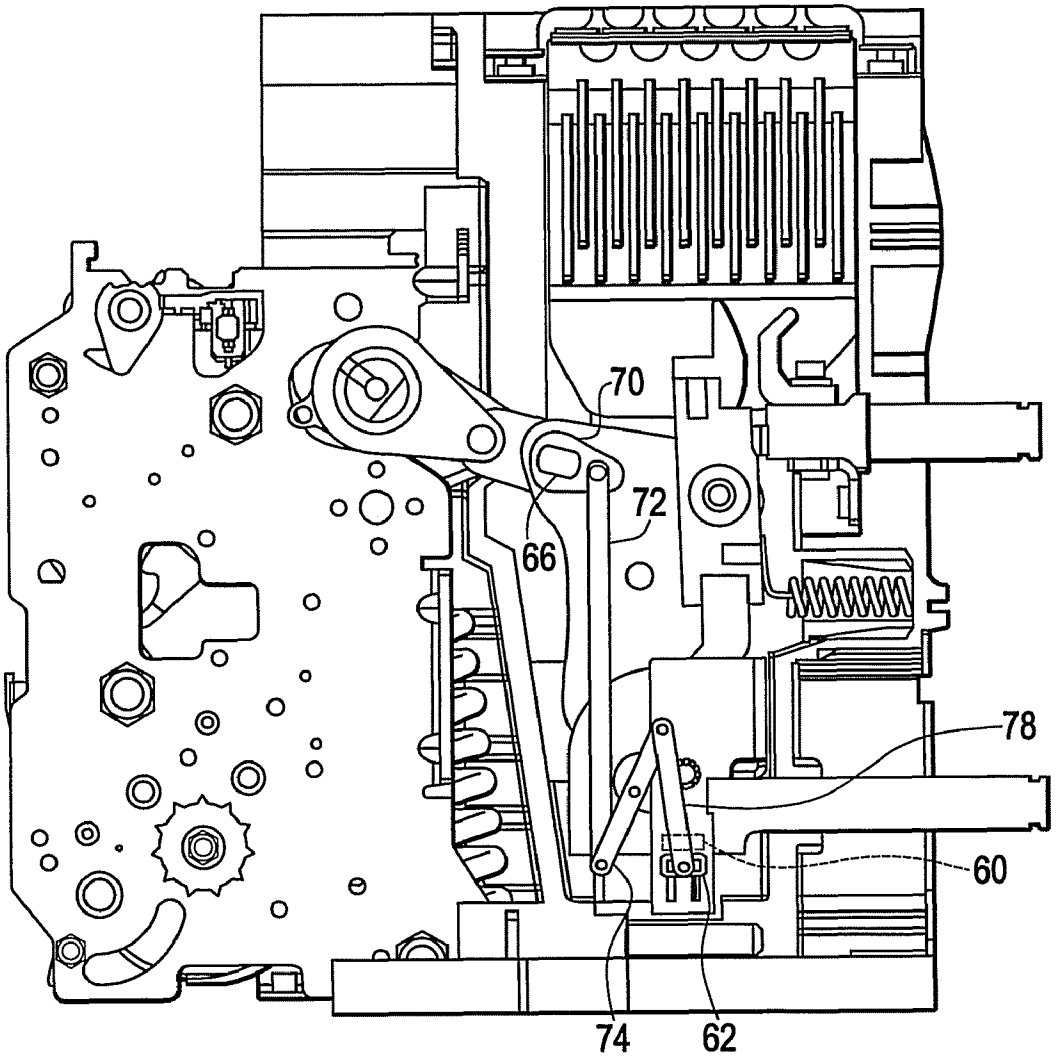
FIG. 8 is a plan side view illustration of the circuit breaker of FIG. 1 where the secondary trip system is actuated.
Figure 9:
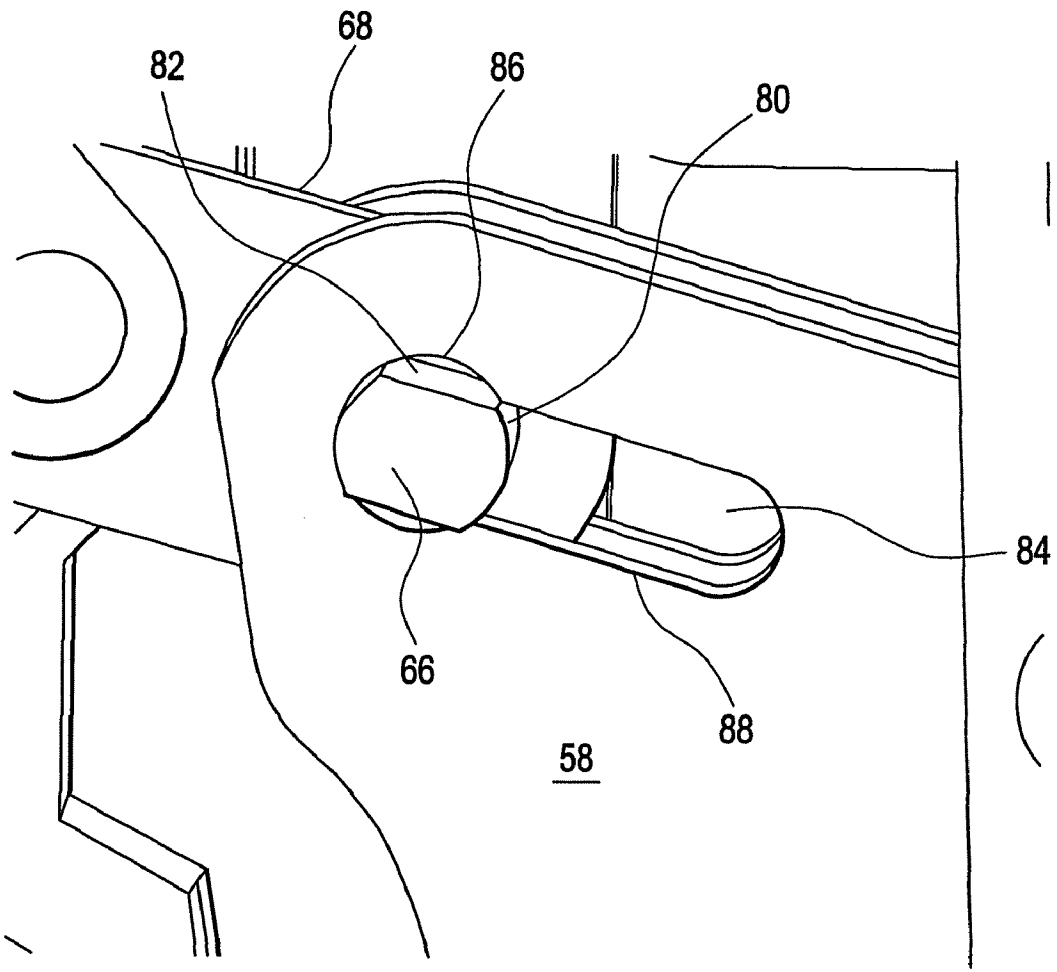
FIG. 9 is a partial perspective view illustration of the contact arm carrier assembly of FIG. 8.

The shaft 66 couples the link 70, the contact arm carrier 58 and the link 68. Link 68 connects the contact arm assembly 38 to the lay shaft assembly 24 by pin 40. The shaft 66 is arranged to rotate within the contact arm carrier slot 84. The shaft 66 is attached to links 68, 70 such that there is no relative motion between the shaft 66 and links 68, 70. As illustrated in FIG. 7, the shaft 66 includes a cylindrical portion 80 and a planar portion 82. The shaft 66 is arranged to rotate in a slot 84 in the contact arm carrier 58. The slot 84 includes a circular portion 86 and an elongated portion 88. When the contact arm assembly 38 is in the locked position as shown in FIG. 2 and FIG. 3, the shaft cylindrical portion 80 is positioned in the slot circular portion 86. When in this locked position, any forces transmitted through the contact arm assembly 38 pass generally through the centers of shaft 66 and pin 40. Due to this arrangement and the positioning of shaft 66 in slot circular portion 86, movement of the contact arm assembly 38 independently from the movement lay shaft assembly 24 is prevented. Thus, during normal operation, the contact arm assembly 38, the shaft 66 and the link 68 move, more or less, as a single rigid linkage when the mechanism 22 rotates the lay shaft 24. This allows the main mechanism to open and close the contact arm assembly 32 without changing the position of the components in contact arm assembly 38 relative to the shaft 66.

During this opening operation, an operator may desire to remove electrical power from a protected circuit, to allow maintenance on equipment connected to the circuit for example. To accomplish this, the main mechanism 22 is activated, by an off push button for example, causing the lay shaft assembly 24 to rotate to an open position as illustrated in FIG. 3. The rotational movement of the lay shaft assembly 24 is translated into motion of the contact arm carrier 58 via link 68 causing the contact arm assembly 38 to rotate about pivot 42. This rotation by the contact arm assembly 38 results in movable contact 46 separating from the stationary contact 52 and the halting of electrical current flow. To re-initiate flow of electrical power, the operator reactivates the main mechanism, by moving a closing push button for example, causing the lay shaft assembly 24 to rotate back to the position illustrated in FIG. 1.

Under certain circumstances, the load connected to conductor 34 may experience an undesired condition, such as a short-circuit for example. Under these conditions, the level of current flowing through the circuit breaker will increase dramatically. For example, under normal operating conditions, circuit breaker 20 may carry 400-5000 A of electricity at 690V. Under short circuit conditions, the current levels may be many times the normal operating levels. For example, depending on the facility in which the circuit breaker 20 is installed, the current levels may reach more than 100 KA. These high levels of current are undesirable and the operator will typically desire to limit the amount of current that flows through circuit breaker 20 under these conditions. As discussed above, the fixed core 60 is arranged in electrical contact with the conductor 32 to generate a magnetic field. During an certain electrical fault conditions, such as the short circuit condition, the magnetic force is generated by fixed core 60 are sufficient to result in movement of armature 62.

The movement of the secondary trip assembly 59 and the contact arm assembly 38 will be described with reference to FIGS. 7-10. It should be appreciated the some of the components have been removed from FIGS. 7-10 for clarity. The movable armature 62 and the linkage assembly 64 are arranged such that when the magnetic force between the fixed core 60 and the moveable armature 62 reaches a predefined level the armature 62 will move towards the fixed core 60. For example, the armature 62 movement may initiate at the magnetic force level corresponding to 25 kA-100 kA and more preferably 50 kA. The different thresholds at which armature 62 moves will depend on selectivity of the circuit breaker 20 with other downstream feeder breakers (not shown). The movement of the armature 62 causes the link 78 to rotate the link 74 about the pivot 76. This rotation in turn results in the link 72 rotating the link 70, shaft 66 and link 68.

Figure 4:
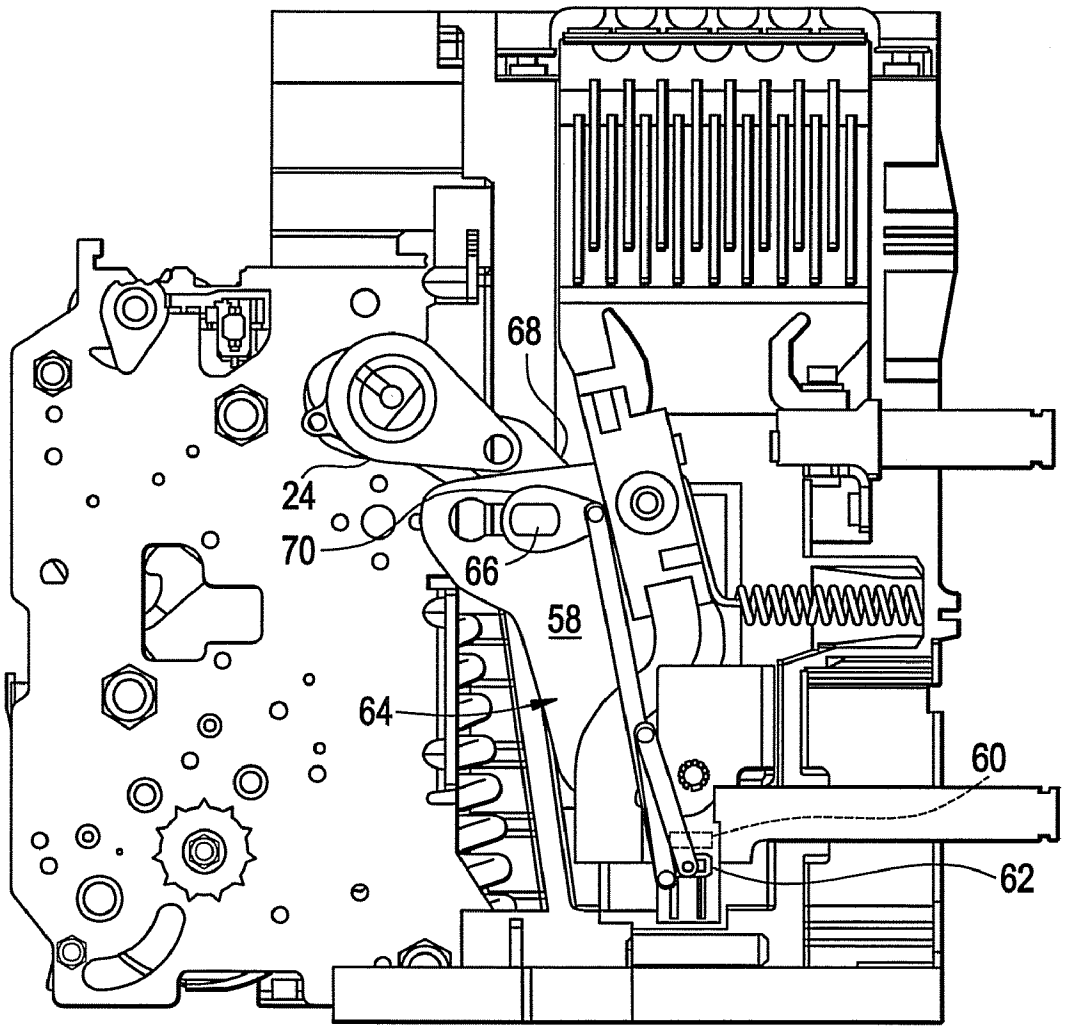
FIG. 4 is a side plan view illustration of the circuit breaker of FIG. 1 with the contact arm in a tripped position.
Figure 5:
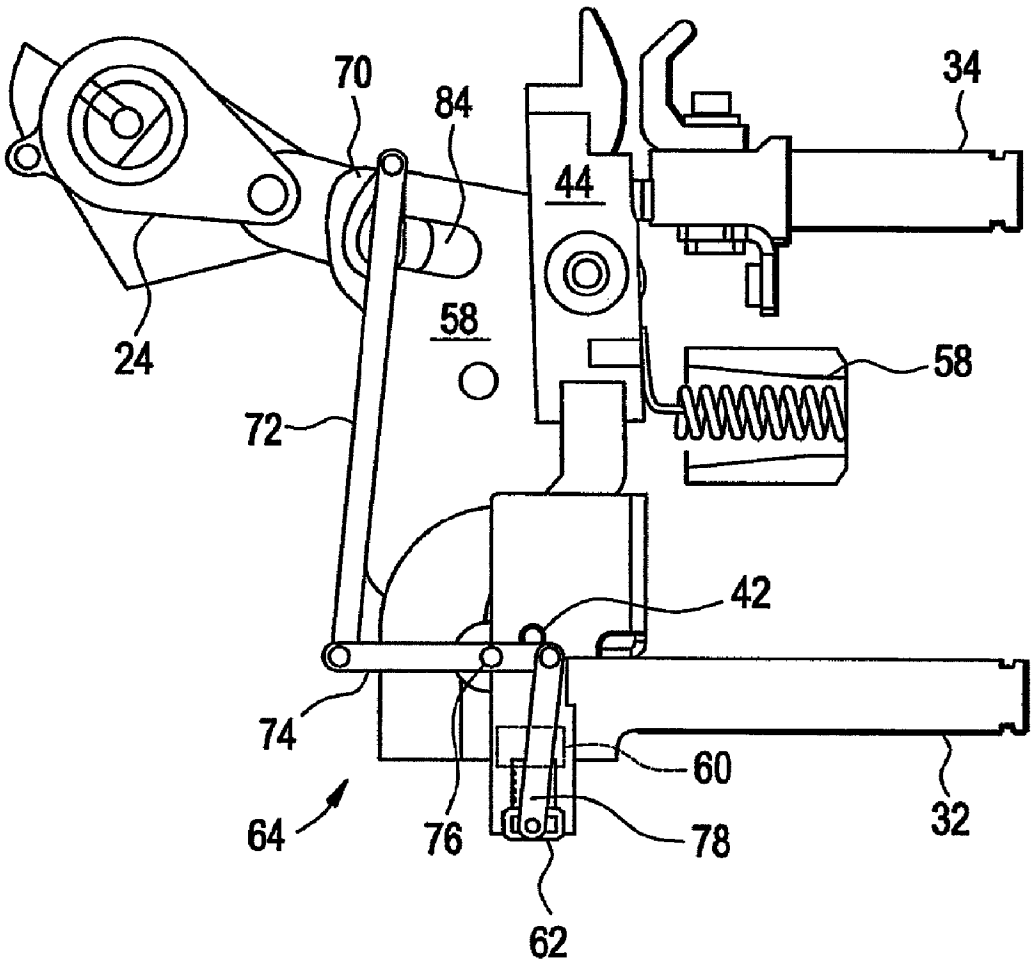
FIG. 5 is a partial side plan view illustration of the contact arm mechanism of FIG. 2.
Figure 10:
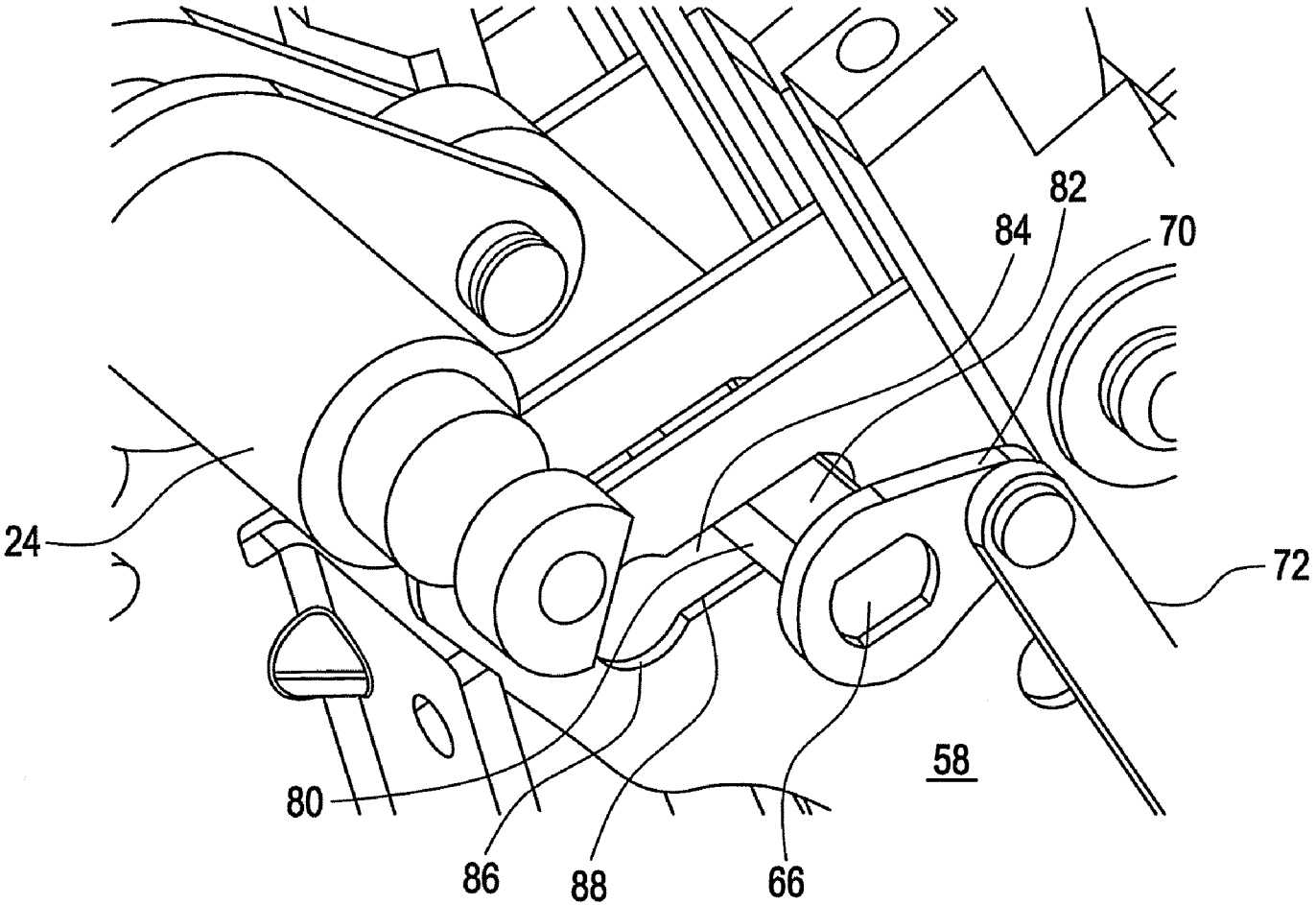
FIG. 10 is a partial plan view illustration of the contact arm carrier assembly of FIG. 4 in the tripped position.

The secondary trip assembly 59 is arranged to rotate the shaft 66 until the planar portion 82 is generally parallel with the sidewalls of slot-elongated portion 88. Upon reaching this position, any reaction force exerted by the shaft 66 on the contact carrier 58 in the direction of the elongated portion of the slot is removed, allowing the shaft 66 and contact carrier to move independently from each other. As the contact arm assembly 38 rotates from the closed position shown in FIG. 2 to the tripped position of FIG. 4, the shaft 66 moves within the slot 84 from the circular portion 86 into the elongated portion 88. Movement of the contact arm assembly 38 may be the result of the force generated by spring 90 or due to magnetic forces between the conductor 34 and the contact arm 44 generated by high current levels during a short circuit. The movement of the contact arm assembly 38 continues until the shaft 66 reaches the end of the slot-elongated portion 88. This position, commonly known as the "tripped" position, is illustrated in FIG. 4 and FIG. 10. In the exemplary embodiment, the end of the slot-elongated portion 88 is curved to match the curvature of shaft cylindrical portion 80. The rotation of the contact arm assembly 38 causes the movable contact 46 to separate from the stationary contact 52. Any electrical arc generated between the contacts 46, 52 is transferred via arcing contacts 48,54 to the arc chute 56 where the energy from the electrical arc is dissipated.

To reset the positioning of the shaft 66 and allow the opening and closing of the contact arm assembly 38, the operator activates the circuit breaker mechanism 22. This rotates the lay shaft assembly 24 to the open position causing the link 68 and shaft 66 to rotate and move within the slot 84. The link 68, shaft 66 and slot 84 are arranged such that as the lay shaft assembly 24 reaches the open position, the shaft 66 is positioned within the slot circular portion 86. Once the shaft 66 is positioned in the slot circular portion 86, the link 68, shaft 66 and contact arm assembly 38 are once again in the locked position allowing them to open and close as a single component.

Allowing the contact arm assembly 38 to separate from the stationary contact 52 without the assistance of the mechanism 22 provides advantages in the operation of the circuit breaker 20. The faster the circuit breaker 20 opens the contact arm assembly 38, the less of electrical current is experienced by the protected load. By utilizing the armature 62 and secondary trip assembly 59, the circuit breaker 20 can react to the undesired electrical condition faster than through the use of mechanism 22 alone. In the exemplary embodiment it is expected that the secondary trip assembly 59 will allow the contact arm assembly 38 to separate in 8-10 milliseconds versus upwards of 30 milliseconds for the mechanism 22. In the exemplary embodiment, it is contemplated that the mechanism 22 will move to the open position after the tripping position is reached, allowing the other poles associated with the circuit breaker to open.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A circuit breaker comprising:

a contact structure movable between a closed and an open position;

a contact carrier coupled to said contact structure, said contract carrier having a slot therein;

a lay shaft assembly coupled to said contact carrier by a shaft disposed in said slot, said shaft being rotatable and movable between a first position and a second position in said slot;

a first linkage assembly operably coupled to said shaft, said first linkage assembly including a first link coupled to said shaft and an armature operably coupled to said first link;

a fixed core in a magnetic relationship with said armature, the fixed core being immovable within the circuit breaker; and at least two springs arranged between said fixed core and said armature.

2. The circuit breaker of claim 1 wherein said armature is arranged to move between an open position and a closed position and said first linkage assembly is arranged to rotate and translate said shaft from said first position to said second position in response to said armature moving from said open position to said closed position.

3. The circuit breaker of claim 2 wherein said shaft is further arranged to move to a third position in said slot.

4. The circuit breaker of claim 3 wherein said shaft is further arranged to move from said second position to said third position when said shaft is rotated to said second position.

5. The circuit breaker of claim 4 wherein said slot has a circular portion corresponding to said shaft first position and a elongated portion, said elongated portion having a first end adjacent said circular portion and an a second end opposite said circular portion, said elongated portion second end corresponding to said shaft third position.

6. The circuit breaker of claim 5 wherein said shaft has a cylindrical portion and a planar portion, said shaft being arranged in said slot such that said cylindrical portion is coaxial with said slot circular portion when said shaft is in said first position.

7. The circuit breaker of claim 6 wherein said shaft is arranged in said slot such that said shaft planer portion is parallel to a length of said elongated portion when said shaft moves from said second position to said third position.

8. The circuit breaker of claim 5, wherein said circular portion of said slot has a diameter that is greater than a width of said elongated portion of said slot.

9. A magnetic trip device for a circuit breaker comprising:

an armature movable between an open position and a closed position;

a fixed core in a magnetic relationship with said armature, the fixed core being immovable within the magnetic trip device;

at least two springs arranged between said fixed core and said armature;

a first link movable between a first position and a second position, said first link being operably coupled to said armature;

a shaft coupled to rotate with said first link, said shaft having a cylindrical portion and a planar portion thereon; and, a contact arm carrier having a slot with a first end and a second end, said contact arm carrier being positioned such that said shaft is arranged in said slot.

10. The magnetic trip device for a circuit breaker of claim 9 further comprising:

a second link having a first and a second end, said second link first end being coupled to said armature;

a third link having a first and a second end and a pivot therebetween, said third link coupled to said second link second end; and, a fourth link coupled between said first link and said third link second end.

11. The magnetic trip device for a circuit breaker of claim 10 wherein said contact arm carrier slot has a circular portion and an elongated portion.

12. The magnetic trip device for a circuit breaker of claim 11 wherein said shaft is arranged to move from said circular portion to said elongated portion in response to said first link moving from said first position to said second position.

13. The magnetic trip device for a circuit breaker of claim 12 wherein said shaft cylindrical portion is coaxial with said slot circular portion when said link is in said first position.

14. A multi-pole circuit breaker comprising:

a mechanism movable between a first and second position;

a first contact arm assembly including at least one contact arm and a contact arm carrier having a slot, said slot having a circular portion and an elongated portion;

a first link coupled between said mechanism and said contact arm carrier, said first link coupled to said contact arm carrier by a shaft positioned in said slot wherein said shaft is arranged to rotate between a first position and a second position in said slot circular portion;

an armature operably coupled to rotate said shaft from said first position to said second position;

a fixed core in a magnetic relationship with said armature, the fixed core immovable within the multi-pole circuit breaker; and at least two springs arranged between said fixed core and said armature.

15. The multi-pole circuit breaker of claim 14 wherein said slot has a first end and a second end and said shaft is arranged to move from said slot first end to said slot second end when said shaft is rotated from said first position to said second position.

16. The multi-pole circuit breaker of claim 15 wherein said first contact arm assembly is arranged to move from a closed position to an open position when said shaft moves from said slot first end to said slot second end.

17. The multi-pole circuit breaker of claim 16 wherein said shaft moves from said slot second end to said slot first end and said shaft rotates from said second position to said first position when said mechanism moves from said first position to said second position.

18. The multi-pole circuit breaker of claim 17 further comprising:

a second contact arm assembly including at least one second contact arm and a second contact arm carrier having a slot;

a second link coupled between said mechanism and second contact arm carrier, said second link coupled to said second contact arm carrier by a second shaft positioned in said slot wherein said shaft is arranged to rotate between a first position and a second position in said second contact carrier slot; and, a second armature operably coupled to rotate said second shaft from said first position to said second position.

19. The multi-pole circuit breaker of claim 18 further comprising:

a first conductor electrically coupled to said first armature and said first contact arm assembly; and, a second conductor electrically coupled to said second armature and said second contact arm assembly.

* * * * *